US005951340A

United States Patent [19]

Mueller et al.

[11] Patent Number: 5,951,340

[45] **Date of Patent: *Sep. 14, 1999**

[54] BUSBAR WITH CONNECTING PIN

[75] Inventors: Beatrice Mueller, Roedermark; Werner Beege, Hainburg, both of Germany

[73] Assignee: Weidmüller Interface GmbH & Co., Detmold, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/602,273

[22] Filed: Feb. 16, 1996

[30] Foreign Application Priority Data

Mar. 25, 1995 [DE] Germany ..... 295 05 107 U

[51] Int. Cl.[6] ..... H01R 13/04

[52] U.S. Cl. ..... 439/891

[58] Field of Search ..... 439/891, 721, 439/723, 724, 879, 741

[56] References Cited

U.S. PATENT DOCUMENTS 2,958,069 10/1960 Redick et al. ..... 439/741
2,990,533 6/1961 Hughes et al. ..... 439/741
3,061,661 10/1962 Seeley ..... 439/741
4,159,500 6/1979 Baumbach et al. ..... 439/721

OTHER PUBLICATIONS

Phönix Catalog, pp. 224–225, 1993.

*Primary Examiner*—Gary Paumen
*Attorney, Agent, or Firm*—Laubscher & Laubscher

[57] ABSTRACT

A busbar assembly for electrical connectors is characterized by a busbar element having a planar surface containing an opening and a connecting pin inseparably connected with said busbar element by inserting one end of the pin into the opening in a snug-fit manner with the pin extending perpendicular to the planar surface. The opening is preferably located in the middle of the planar surface, thereby eliminating the need for punch-outs on the busbar element. The element further has large support surfaces on opposite sides of the opening which distribute and absorb the forces generated during insertion of the pin into a printed circuit board.

7 Claims, 1 Drawing Sheet

BUSBAR WITH CONNECTING PIN

BACKGROUND OF THE INVENTION

The present invention relates to a busbar with a connecting pin for electrical connectors. The connecting pin is oriented perpendicularly with respect to the plane of one of the surfaces of the busbar element.

BRIEF DESCRIPTION OF THE PRIOR ART

In conventional busbar assemblies, busbar elements with an L-shaped configuration and a perpendicularly arranged connecting pin are made in one piece with the connecting pin being formed by punching out the corresponding surface segment of the busbar element and by bending it out or angling it off. In the formation process, both the busbar and the connecting pin are weakened and, in particular, the lateral punch-out causes an asymmetry in the assembly.

Connecting pins can be designed for different connection techniques such as, for example, soldering pins, wire wrap, press-in pins and the like. The L-shaped design described herein has a particularly negative effect when pressing it in a circuit board by way of a connection technique because very strong forces can occur during the insertion process. In the known undivided busbar assemblies, these forces are transferred via the bending radius of the connecting pin which can lead to lasting deformations in the assembly. The asymmetry also leads to an uneven force distribution within the busbar assembly because of the strong surface pressure between the busbar and the housing of the electrical conductor within which the assembly is mounted. This is because in many cases only small support surfaces are available on the busbar, especially in the case where the connecting pin is formed by punching out the connecting pin.

As disclosed in the 1993 catalog of Firma Phoenix, busbar assemblies are known where the connecting pins are welded on the outside of the busbar surface to surface pins that protrude upwardly. The connecting pins extend in the plane of the main surface of the busbar element. As before, the transmission of stronger forces during connection of the busbar with a printed circuit board is a problem because the press-in force must be absorbed completely via the welding connection between the connecting pin and the busbar surface because there is an eccentric force that is introduced into the busbar.

The present invention was developed in order to overcome these and other drawbacks of the prior devices by providing a busbar assembly that is particularly suitable for absorbing and transmitting strong forces without any damage to the assembly during its press-in connection in a printed circuit board.

SUMMARY OF THE INVENTION

Accordingly, it is a primary object of the present invention to provide a busbar assembly where the connecting pin is inserted into an opening in the main surface of the busbar element in a form-locking manner and is inseparably connected with the busbar. As a result, there is no need for a punch-out pin, and relatively large support surfaces are available for distribution of stress forces on the assembly. The opening is preferably arranged in the middle of the busbar element so that the element can be made symmetrical with respect to an adjoining housing, especially in the reception area of the connecting pin and in the area of the support surfaces. As a result, the stress forces can be distributed uniformly. With the help of the form-locking plug-in connection between the connecting pin and the receiving opening in the busbar, forces can be transferred from the connecting pin to the busbar element via the form-locking connection, circumventing the connection that inseparably connects the connecting pin with the busbar element.

As a result of this design, there is now sufficient room on the busbar surface so that several connecting pins can be fixed in place in a tight sequence on the busbar element. During production, there can also be provided a rapid exchange of the type of connection between the pin and the busbar element, i.e. from a soldering pin to a press-in pin. By the same token, it is possible to change the connecting profiles without having to alter any punch/bending tools as is necessary with undivided busbars. Moreover, different materials for the connecting pin and busbar element can be selected in accordance with ambient temperature, environmental influences, and the like.

According to a preferred embodiment, the inseparable connection between the connecting pin and the busbar element is achieved by welding, and preferably laser welding. For this purpose, the connecting pin is designed to protrude slightly beyond the element surface after it has been inserted into the opening in the form-fit fashion to provide a portion available for the laser welding. The form-fitting connection can be created in a simple manner by providing shoulders on the connecting pin that abut against the busbar element when the pin has been fully inserted into the opening. The busbar element also includes integral support surface portions which extend laterally on opposite sides of the opening to absorb some of the forces generated during mounting of the busbar assembly on a printed circuit board.

BRIEF DESCRIPTION OF THE FIGURES

Other objects and advantages of the invention will become apparent from a study of the following specification when viewed in the light of the accompanying drawing, in which.

DETAILED DESCRIPTION

Figure 3:
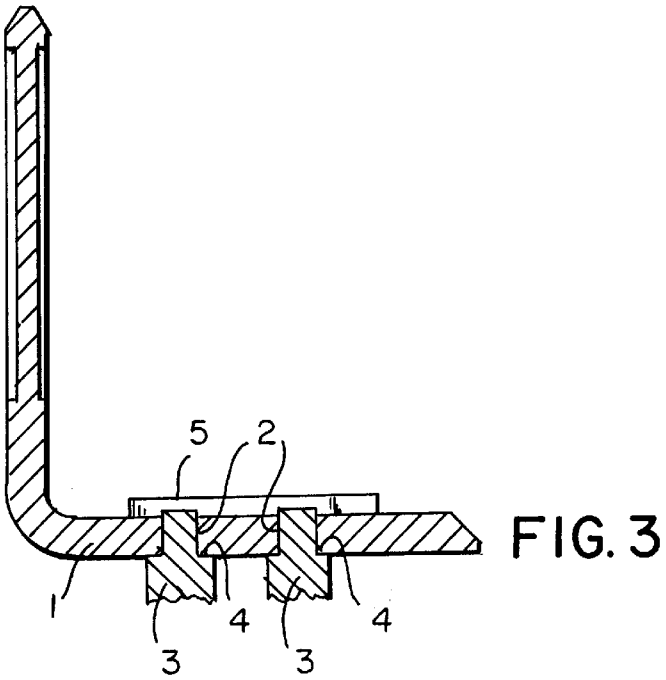
FIG. 3 is a sectional view similar to FIG. 2 of an alternate embodiment of the invention where a plurality of connecting pins are inseparably connected with the busbar element.
Figure 2:
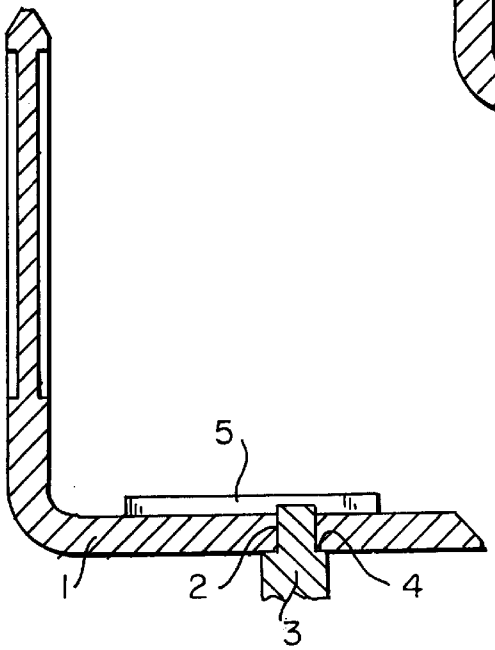
FIG. 2 is a sectional view of the busbar assembly of FIG. 1 with the connecting pin inseparably connected with the busbar element.
Figure 1:
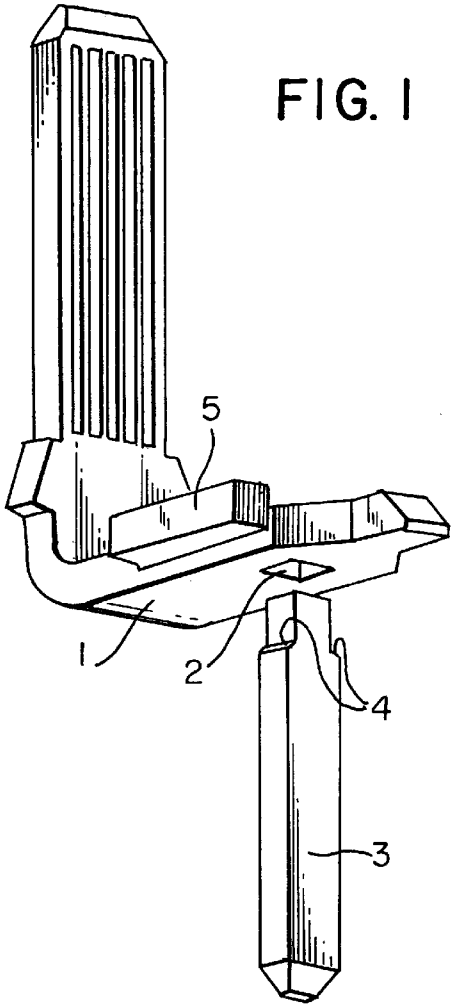
FIG. 1 is an exploded perspective view of the busbar assembly according to the invention.

The busbar assembly shown in FIGS. 1–3 includes an L-shaped busbar element 1, one leg of which contains a through-opening 2. In the preferred embodiment illustrated in the drawing, the opening has a square cross-section, but it will be appreciated that the opening may have any desired configuration including round or rectangular. The opening is preferably arranged in the center of the busbar element leg, in the plane of the main surface of the element in relation to the two narrow sides of the busbar element. An elongated connecting pin 3 has one end configured to match the configuration of the opening and is adapted for insertion into the opening so that the connecting pin is positioned in the middle of the leg surface and extends perpendicularly with respect to the plane containing the leg surface. In FIG. 1, the connecting pin is shown as being inserted into the busbar element opening from beneath the planar surface.

The connecting pin is inseparably connected with the busbar element. According to the preferred embodiment, the inseparable connection is made by laser welding the pin end to the busbar element. Accordingly, the pin end is designed to protrude slightly from the leg surface as shown in FIG. 2 to allow the welding material to be applied to the protruding pin end/leg surface interface.

The pin is also connected with the busbar element via a form locking or snug fit manner. As shown in the drawing, the pin 3 has adjoining shoulders 4 on two opposite sides, with the shoulders abutting against the lower surface of the busbar element when the pin end has been fully inserted into the opening 2 from below. This insures that the welding seam will not be stressed either during the inseparable connection process or during insertion of the other end of the connecting pin into a printed circuit board.

Depending on the desired connection technique, the connecting pin 3 is formed in different shapes, such as for example as a soldering pin, wire wrap, or especially as a press-in pin for pressing into a printed circuit board. As a result of the central positioning of the pin and by virtue of the form-locking connection between the connecting pin and the busbar element, strong forces can be transmitted from the connecting pin to the busbar without damaging the assembly because the welding connection between the pin and the busbar element is isolated from these forces. Rather, these forces are distributed uniformly over a relatively large busbar surface. This distribution of forces is enhanced by providing integral support surfaces 5 along the narrow outer sides of the leg surface opposite the receiving area of the connecting pin 3 for transmitting the forces to adjoining housing sectors of an electrical connector. The support surfaces can be arranged in a plane other than the plane of the leg surface as shown in FIG. 2.

With this design, there is sufficient space along the busbar element in order to accommodate several connecting pins in a tight configuration as shown in FIG. 3. Moreover, depending on the function of the busbar element or the requirements regarding electrical currents, ambient temperatures, environmental influences and the like, different raw materials can be used for the busbar element and the connecting pin.

Although the opening 2 in the busbar element leg surface is illustrated as being arranged in the center thereof, it can also be provided off center without reducing the supporting surface of the busbar assembly.

While in accordance with the provisions of the patent statute the preferred forms and embodiments of the invention have been illustrated and described, it will be apparent to those of ordinary skill in the art that various changes and modifications may be made without deviating from the inventive concepts set forth above.

What is claimed is:

1. A busbar assembly for electrical connectors, comprising (a) a busbar element having at least one planar portion having a planar surface and containing a through-opening, said portion including integral support portions extending laterally from one surface thereof on opposite sides of said opening and having support surfaces contained in a plane above and parallel to said planar surface; and (b) an elongated connecting pin inseparably connected with said busbar element by insertion of one end of said pin into said opening, said pin one end and said opening having corresponding configurations and dimensions and said pin one end protruding slightly from said planar portion between said support portions and recessed relative to said support surfaces, said pin being connected with said busbar element in a press-in snug-fit manner, said pin having a longitudinal axis arranged perpendicular to said planar portion and a pair of shoulders on opposite sides and recessed relative to said pin one end, said shoulders abutting against said busbar element planar portion adjacent to said opening when said pin one end is inserted into said opening, whereby said support portions, said pin shoulders, and said snug-fit connection provide a busbar assembly that is particularly suitable for absorbing and transmitting strong forces without any damage to the assembly during connection of said pin with a printed circuit board.

2. A busbar assembly as defined in claim 1, wherein said opening is centrally arranged in said planar portion.

3. A busbar assembly as defined in claim 2, wherein said pin is welded to said busbar planar portion.

4. A busbar assembly as defined in claim 3, wherein said pin is laser welded to said busbar planar portion.

5. A busbar assembly as defined in claim 1, wherein said busbar element contains a plurality of openings for receiving a plurality of connecting pins, respectively.

6. A busbar assembly as defined in claim 1, wherein said busbar element and said connecting pin are formed of different materials, respectively.

7. A busbar assembly as defined in claim 1, wherein said opening is arranged off-center of said planar portion.

* * * * *